US012385281B2

(12) United States Patent
Neron

(10) Patent No.: US 12,385,281 B2
(45) Date of Patent: Aug. 12, 2025

(54) SYSTEM AND METHOD FOR PULLING A STAKE FROM A SURFACE

(71) Applicant: Jean Neron, Sherbrooke (CA)

(72) Inventor: Jean Neron, Sherbrooke (CA)

( * ) Notice: Subject to any disclaimer, the term of this patent is extended or adjusted under 35 U.S.C. 154(b) by 367 days.

(21) Appl. No.: 17/659,310

(22) Filed: Apr. 14, 2022

(65) Prior Publication Data

US 2022/0333403 A1 Oct. 20, 2022

Related U.S. Application Data

(60) Provisional application No. 63/174,869, filed on Apr. 14, 2021.

(51) Int. Cl.
*B66F 5/00* (2006.01)
*E04H 17/26* (2006.01)

(52) U.S. Cl.
CPC ..... *E04H 17/265* (2013.01)

(58) Field of Classification Search
CPC ..... E04H 17/265; B66F 5/00; B66F 1/00
See application file for complete search history.

(56) References Cited

U.S. PATENT DOCUMENTS 2,681,789 A 6/1954 Nichols
7,017,962 B2 3/2006 Toensing
8,282,077 B1 * 10/2012 Bonney ..... B66F 3/24 414/23
8,356,799 B2 1/2013 Cheslock
2017/0159323 A1 * 6/2017 Graves ..... E04H 17/265
2020/0157841 A1 * 5/2020 Blank ..... E04H 17/265
2023/0220700 A1 * 7/2023 Davis ..... E04H 17/265 254/30

OTHER PUBLICATIONS

APG Australia. "Post puller Demo". YouTube [Online] [Video]. Aug. 15, 2016 [retrieved on Aug. 25, 2023]. Retrieved from https://youtube.com/watch?v=mPZOClusXFc.

Operating manual of the RHINOTM PL-3 Hydraulic Post Puller (not dated)—https://rhinotool.com/wp-content/uploads/2021/11/PL-3_WEB.pdf.

* cited by examiner

*Primary Examiner* — Lee D Wilson
(74) *Attorney, Agent, or Firm* — Brouillette Legal Inc.; Philippe Brouillette

(57) ABSTRACT

A stake removal tool configured for removing in-ground stakes, the stake removal tool comprising an elongated member defining a proximal end and a distal end, a carriage, and a lift system configured to drive the carriage along a longitudinal direction of the elongated member. The carriage comprises a chassis and a pivoting member configured to pivot about a fulcrum and defining first and second engagement members. As the lift system engages the carriage to displace it downwardly in a longitudinal direction of the elongate member, the first and second pivot members may be forced to pivot thereby engaging and dislodging a stake.

21 Claims, 11 Drawing Sheets

SYSTEM AND METHOD FOR PULLING A STAKE FROM A SURFACE

CROSS-REFERENCE TO RELATED APPLICATIONS

The present patent application claims the benefits of priority of U.S. Provisional Patent Application No. 63/174,869, entitled "SYSTEM AND METHOD FOR REMOVING A STAKE", and filed at the United States Patent Office on Apr. 14, 2021, the content of which is incorporated herein by reference.

FIELD OF THE INVENTION

The present invention generally relates to the field of mechanical tools and methods thereof and, more particularly, to tools for removing in-ground stakes and associated methods of use.

BACKGROUND OF THE INVENTION

Commonly used in construction projects, stakes serve multiple purposes from surveying to securing concrete. In particular, they provide a temporary marker or support in various construction projects. The stakes are commonly made of metal, wood or plastic and comprise a pointed end allowing them to be driven deep into the soil or concrete using a sledgehammer thereby increasing their stability.

Stakes are often manually removed once a project is complete or if they are no longer required. Depending on the depth at which the stakes are buried or the material they are buried in, their removal can prove challenging and time consuming. Moreover, the large number of stakes commonly used in construction projects can often be physically exhausting for workers while extending the construction time.

Various stake removal tools have been proposed for the easy removal of stakes. For example, U.S. Pat. No. 7,017,962 discloses a stake removal tool having two handles linked by a link bar, wherein the limits of the handles define gripper surfaces being opposite to one another. The gripper surfaces are spaced apart to allow a stake to be positioned therebetween which can be engaged by the gripper surfaces for removal.

U.S. Pat. No. 8,356,799 discloses a stake removal tool comprising two loops disposed on opposite ends of the device. A first loop is configured to receive a top end of a stake while the second loop is configured to receive a user's forearm. As the user engages the device, the first loop tightens around the stake thereby facilitating its removal.

The use of the aforementioned removal tools presents certain drawbacks, namely the continued physical effort required by the users. There is therefore a need for a manual or powered stake removal tool.

SUMMARY OF THE INVENTION

The shortcomings of the prior art are generally mitigated by a stake removal tool configured for removing in-ground stakes, the stake removal tool comprising an elongated member defining a proximal end and a distal end, a carriage, a lift system configured to drive the carriage along a longitudinal direction of the elongated member, and a fulcrum, wherein the carriage comprises a chassis and a pivoting member configured to pivot about the fulcrum and defining first and second engagement members, the engagement members being configured to engage the stake and grasp the stake when the pivoting member is pivoted.

The pivoting member may further define a passage between the first and second engagement members, wherein the passage has a dimension along an axis normal to a longitudinal axis of the stake being smaller than a width of the stake when the pivoting member is suspended, and wherein the dimension along the axis normal to the longitudinal axis of the stake of the opening is greater than the width of the stake when the pivoting member is pivoted about the fulcrum. A rotation of the pivoting member may be limited by the width of the stake when said stake is in the opening and the pivoting member is pivoted.

The pivoting member may be configured to remove the stake from the ground when the engagement members grasp the stake and the carriage is driven upwardly, and the pivoting member may loosely pivot about a pivot point of the carriage. The pivoting member may pivot about an elongated aperture of the carriage and the lift system may comprise an endless gear configured to threadingly engage the carriage.

The stake removal tool may further comprise a resilient member adapted to dampen a displacement of the carriage at the distal end of the elongated member, and the lifting system may comprise an elongated rod, the elongated rod comprising a threaded portion threadingly engaging the carriage, an axle portion for receiving the resilient member, and a drive connector.

The stake removal tool may further comprise a bearing adapted to receive and rotate the elongated rod, the lifting system may be unitary, and at least one of the first and second engagement members may comprise serrations.

The shortcomings of the prior art are further mitigated by a method for removing a stake from a surface, the method comprising driving a carriage toward the stake along an elongated member, inserting the stake into an opening of a pivoting attachment member, and driving the carriage to suspend the pivoting member and to grasp the stake with the attachment member.

The method may further comprise pivoting the attachment member to a position being substantially normal to a longitudinal axis of the stake prior to inserting the stake into the opening, wherein grasping the stake may comprise pressing serrations of first and second engagement members of the attachment member against a surface of the stake.

The method may further comprise dampening a displacement of the driving carriage and/or aligning an axle of a drive system with a rotational axis of the endless screw, wherein driving the carriage may comprise rotating an endless screw configured to threadingly engage the carriage.

In yet another aspect of the present invention, a stake removal tool configured for removing in-ground stakes is provided. The stake removal tool comprises an elongated member defining a proximal end and a distal end, a carriage comprising a stake engagement assembly configured to engage and grasp the stake, a lift system configured to drive the carriage along a longitudinal direction of the elongated member, wherein the carriage is disengageable yet engageable to the lift system.

The stake removal tool may further comprise a fulcrum and the carriage may further comprise a pivoting member configured to pivot about the fulcrum to engage the stake. The engagement assembly may comprise first and second engagement members, the first and second engagement members being configured to engage the stake and grasp the stake when the pivoting member is pivoted. The pivoting member may further define a passage between the first and second engagement members. The passage may have a dimension along an axis normal to a longitudinal axis of the stake being smaller than a width of the stake when the pivoting member is suspended. The dimension along the axis normal to the longitudinal axis of the stake of the opening may be greater than the width of the stake when the pivoting member is pivoted about the fulcrum. A rotation of the pivoting member may be limited by the width of the stake when said stake is in the opening and the pivoting member is pivoted.

The pivoting member may be configured to remove the stake from the ground when the engagement members grasp the stake and the carriage is driven upwardly. The pivoting member may loosely pivot about a pivot point of the carriage. The pivoting member may pivot about an elongated aperture of the carriage.

The stake removal tool may further comprise a resilient member for engaging the carriage to the lift system. The resilient member may be a spring pushing the disengaged carriage to be engaged by the lift system. The lifting system may comprise an elongated rod rotatably attached to the stake removable tool, the elongated rod comprising a threaded portion for threadingly engaging the carriage and a non-threaded axle portion for receiving the resilient member and for disengaging the carriage.

The at least one of the first and second engagement members may comprise serrations.

In yet another aspect of the invention, a method for removing a stake from a surface is provided. The method comprises driving a carriage downward toward the stake along an elongated member, disengaging the carriage from the elongated member, inserting the stake into an opening of an attachment member, engaging the disengaged carriage to the elongated member and driving the carriage upward to grasp the stake with the attachment member.

The method may further comprise pivoting the attachment member to a position being substantially normal to a longitudinal axis of the stake prior to inserting the stake into the opening.

The grasping of the stake may comprise pressing serrations of first and second engagement members of the attachment member against a surface of the stake. The disengagement of the carriage further may comprise driving the carriage to a threadless portion of the elongated member.

The engagement of the carriage may further comprise pushing the carriage from the threadless portion of the elongated member to a threaded portion of the elongated member. The method may further comprise using a resilient member pushing the carriage from the threadless portion of the elongated member to a threaded portion of the elongated member. The driving of the carriage may further comprise using a drive system to rotate the elongated member to drive the carriage.

The method may further comprise pivoting the attachment member to insert the stake in the opening and suspending the pivoted attachment member to grasp the stake with the attachment member.

In another aspect of the invention, a stake removal tool configured for removing in-ground stakes is provided. The stake removal tool comprises an elongated member defining a proximal end and a distal end, a carriage comprising a stake engagement assembly configured to engage and grasp the stake, a lift system configured to drive the carriage along a longitudinal direction of the elongated member, a carriage disengagement member adapted to disengage the driven carriage from the lift system and a carriage engagement member adapted to engage the disengaged carriage to the lift system.

In a further aspect of the invention, a method for removing a stake from a surface is provided. The method comprises driving a carriage downward toward the stake along an elongated member, disengaging the carriage from the elongated member upon reaching an end portion of the elongated member, inserting the stake into an opening of an attachment member of the carriage, moving the disengaged carriage to be engaged to the elongated member and driving the engaged carriage upward to grasp the stake with the attachment member.

Other and further aspects and advantages of the present invention will be obvious upon an understanding of the illustrative embodiments about to be described or will be indicated in the appended claims, and various advantages not referred to herein will occur to one skilled in the art upon employment of the invention in practice.

BRIEF DESCRIPTION OF THE DRAWINGS

The above and other aspects, features and advantages of the invention will become more readily apparent from the following description, reference being made to the accompanying drawings in which.

DETAILED DESCRIPTION OF THE INVENTION

A novel system and method for removing a stake will be described hereinafter. Although the invention is described in terms of specific illustrative embodiments, it is to be understood that the embodiments described herein are by way of example only and that the scope of the invention is not intended to be limited thereby.

Figure 1:
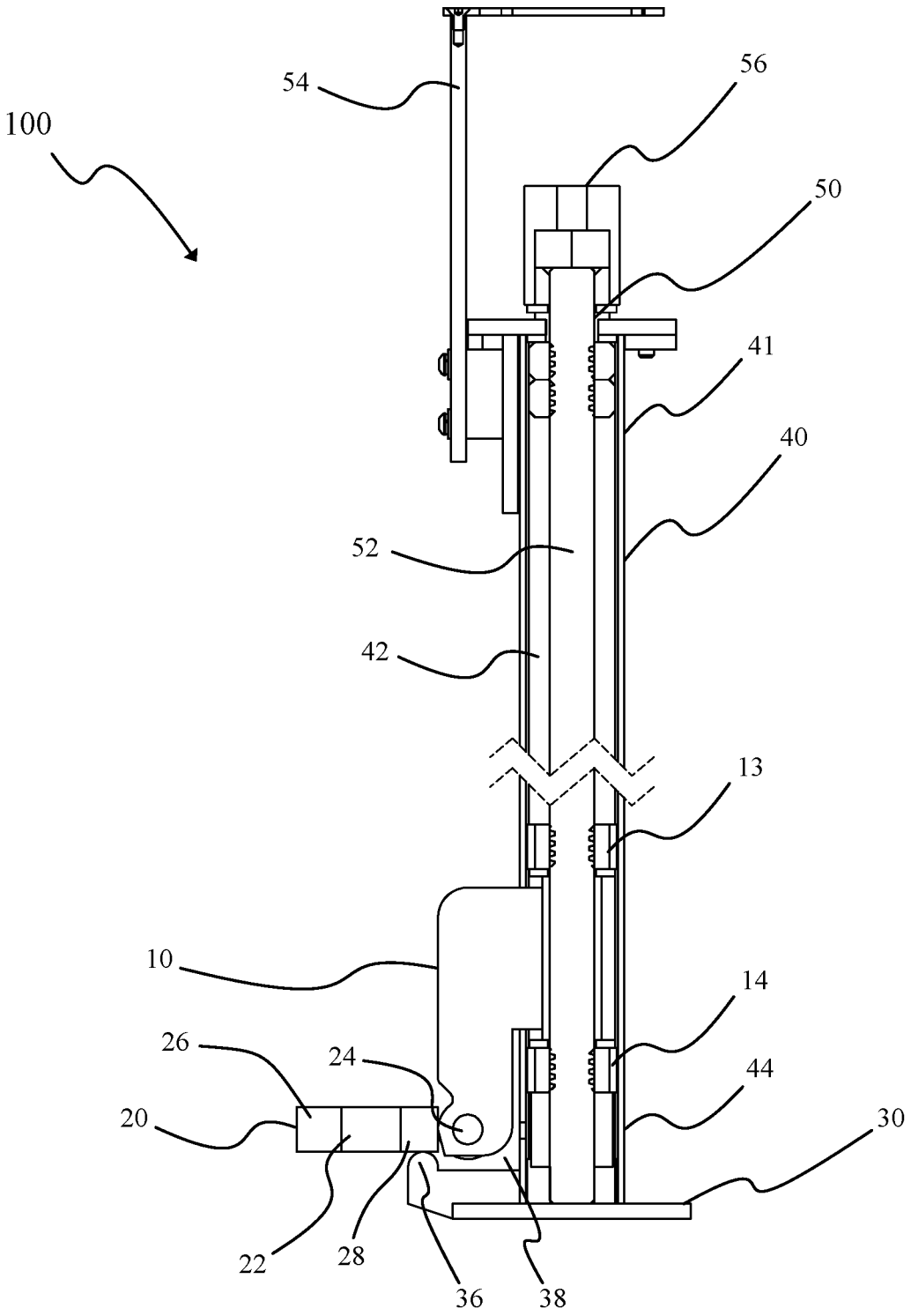
FIG. 1 is a right side elevation view of an embodiment of a stake removal tool in accordance with the principles of the present invention.
Figure 2:
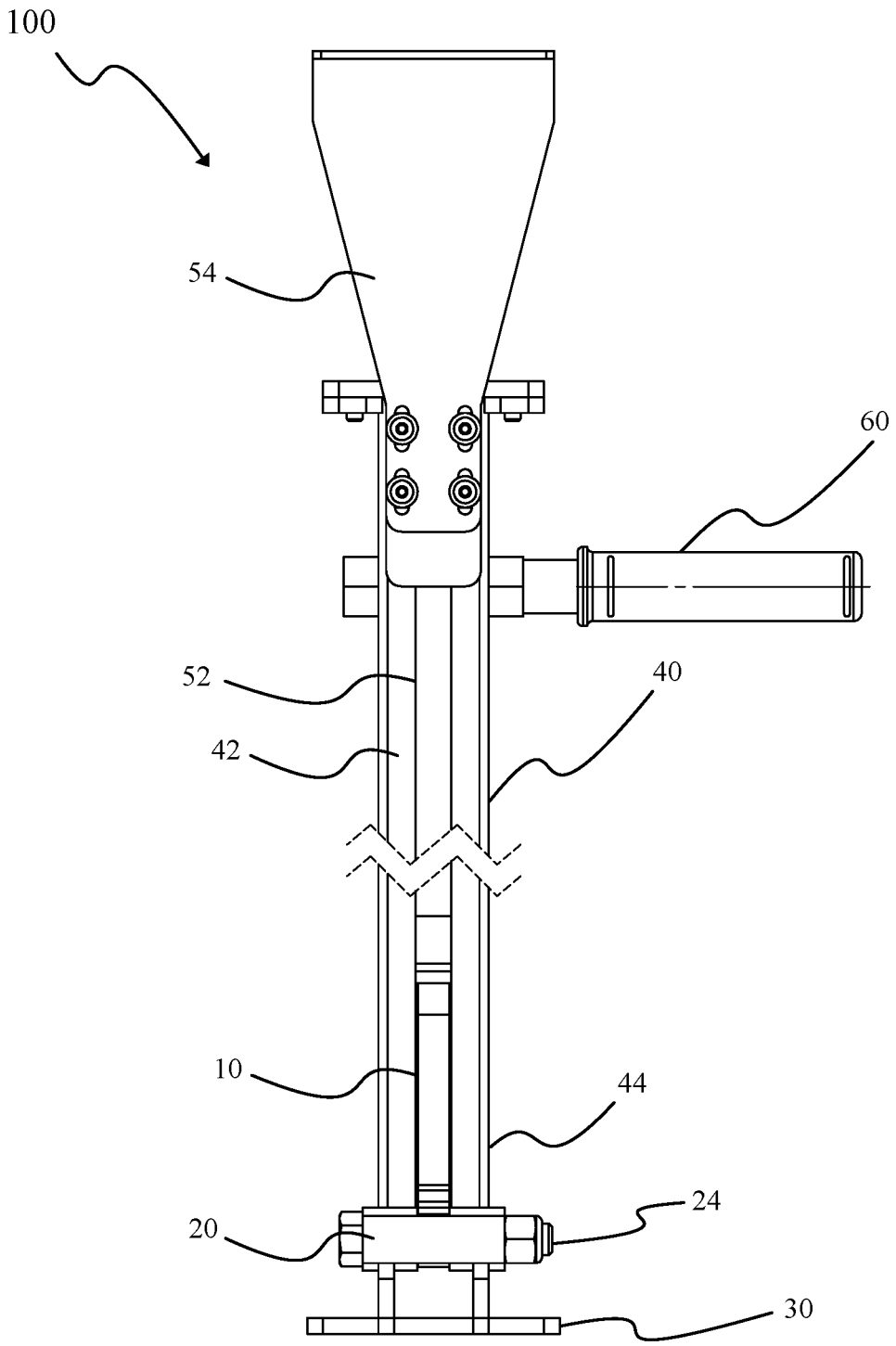
FIG. 2 is a front elevation view of the stake removal tool of FIG. 1.
Figure 3:
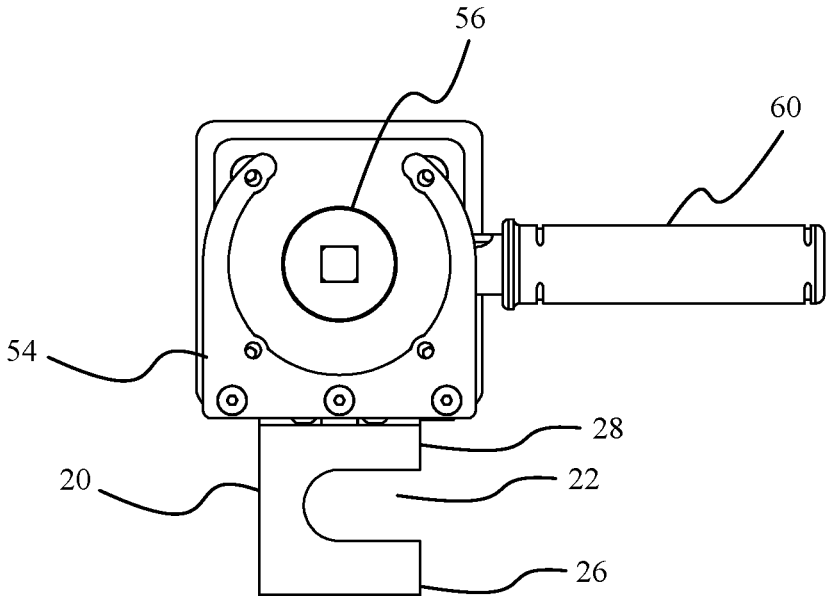
FIG. 3 is a top plan view of the stake removal tool of FIG. 1.
Figure 4:
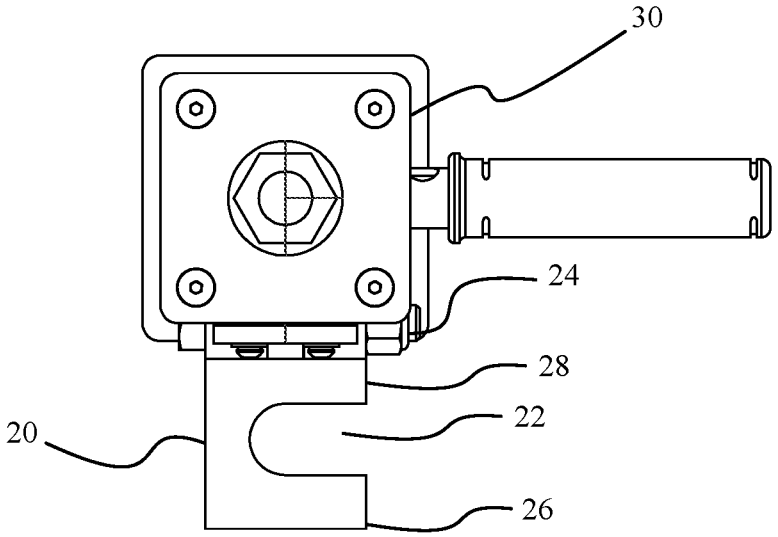
FIG. 4 is a bottom plan view of the stake removal tool of FIG. 1.

Referring to FIGS. 1 and 2, an embodiment of a tool 100 for the removal of an in-ground stake 5 out of the ground 7 (shown in FIG. 7) is illustrated. The stake removal tool 100 typically comprises a carriage 10, an attaching system 20, a base 30, an elongated member 40 and a lifting system 50.

The elongated member 40 typically defines a proximal end 41 adapted to be manipulated by a user and a distal end 44 adapted to engage a stake.

The base 30 is typically affixed at a distal end 44 of the elongated member 40 and is generally adapted to support the stake removal tool 100 when in use. Still referring to FIGS. 1 and 2, the stake removal tool 100 comprises a substantially flat base 30 which is adapted to be disposed substantially parallel to the ground 7.

The base 30 may be affixed to the elongated member 40 using a fastener, an adhesive or any other suitable method. In other embodiments, the base 30 may be detachably affixed to the elongated member 40 and selectively affixed when required. In yet other embodiments, the base 30 may be pivotally attached to the distal end 44 of the elongated member 40, generally aiming at conforming with an uneven ground 7.

The stake removal tool 100 may further comprise a carriage 10 configured to be moved longitudinally in relation with the elongated member 40. To that end, the carriage 10 may be slidably attached to the elongated member 40 using any suitable means. The carriage 10 generally comprises an attachment portion 12 (shown in FIG. 5). The attachment portion 12 may comprise upper and lower threaded ends 13, 14. The carriage 10 may further comprise a pivot point 15 adapted to pivotally receive the attaching system 20.

In certain embodiments, the stake removal tool 100 further comprises a lift system 50. The lift system 50 may extend along the elongated member 40 and is adapted to displace the carriage 10 along the said elongated member 40. The lift system 50 may comprise any suitable mechanism for generating a displacement of the carriage along the elongated member 40, such as but not limited to, an endless screw, a screw jack, a belt system, a magnetic system or any combination thereof. Referring again to FIGS. 1 and 2, the lift system 50 of the present embodiment comprises a screw jack or endless screw 52 disposed along the length of the elongated member 40. In a preferred embodiment, the endless screw 52 is within an inner cavity 42 of the elongated member 40. The endless screw 52 may have any length suitable to displace the carriage 10 along a desired length of the elongated member 40. It may be appreciated that, in other embodiments, the lift system 50 may be disposed externally to the elongated member 40.

Figure 5:
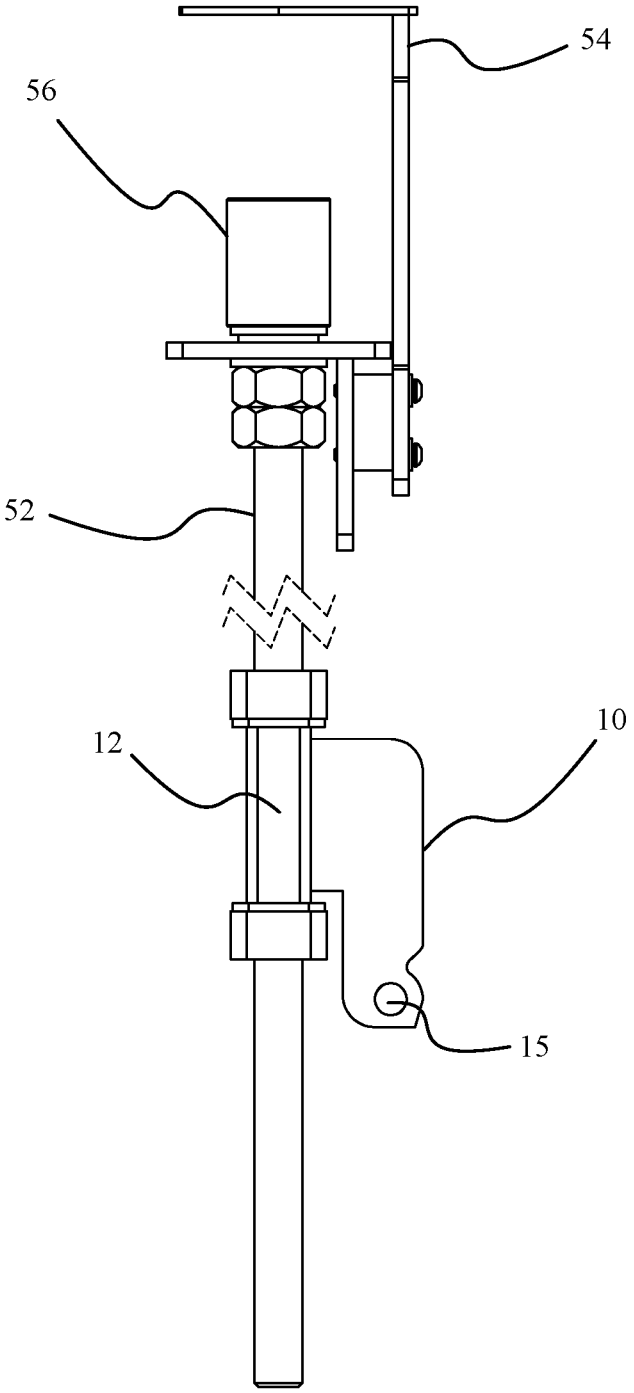
FIG. 5 is a right side elevation view of an exemplary lift system used in the stake removal tool of FIG. 1.

In order to displace the carriage 10, the lift system 50 may engage or may be attached to the attachment portion 12 of the carriage 10. Referring now to FIG. 5, the attachment portion 12 may additionally form part of a chassis of the carriage 10. In accordance with the present embodiment, the attachment portion 12 may be embodied as a threaded portion configured to receive the endless screw 52. As shown in FIGS. 1 and 5, the attachment portion 12 may comprise upper and lower threaded ends 13, 14. The threaded ends 13, 14 may be configured to engage the endless screw 52. To that end, a rotation of the endless screw 52 engages the threaded portion 12 of the chassis to drive the carriage 10 along the longitudinal axis of the elongated member 40.

The gripping or attaching system 20 may be attached to or unitary with the carriage 10. Broadly, the attaching system 20 is adapted to grip or firmly retain the stake 5 when the carriage 10 is moved upwardly. The attaching system 20 may additionally comprise one or more aperture or openings 22 allowing the passage of the stake 5.

Referring now to FIGS. 1 to 4, in some embodiments, the stake removal tool 100 may comprise a substantially flat attaching system 20 comprising the opening 22. The opening 22 may be large enough to receive a portion of the stake 5 positioned above the ground 7 but without being affixed thereto. In a preferred embodiment, the attaching system 20 and the opening 22 define a substantially U-shaped holder allowing the stake to be inserted either by downwardly moving the tool toward the ground 7 above the stake 5 or by sliding the stake 5 within the opening 22 to allow later engagement. In said embodiment, the ends of the opening 22 may define first and second gripping members 26, 28 with the first gripping member 26 being positioned distally from the elongated member 40 relative to the second gripping member 28.

In the illustrated embodiment, the attaching system 20 comprises a supporting member or link 24 for pivotally attaching the attaching system 20 to the carriage 10. The attaching system 20 may therefore be pivotally attached to the carriage 10 at the pivot point 15 of the carriage 10. The supporting member 24 may comprise a pin, a bolt or any other suitable component.

Referring now to FIG. 1, the stake removal tool 100 may comprise a protrusion or fulcrum 36 providing a support for a pivoting of the attaching system 20 about the pivot point 15. In certain embodiments, the fulcrum 36 may be affixed to the base 30 using any suitable means. In other embodiments, the fulcrum 36 may be affixed to the elongated member 40, or the fulcrum 36 and the base 30 may form a single unitary piece. The base 30, the fulcrum 36 and the elongated member 40 may additionally define a recess 38 disposed therebetween.

In certain embodiments, the attaching system 20 may be loose about the pivot point 15 to be impacted by gravitational forces and to allow a free rotation thereabout. Accordingly, the attaching system 20 may tilt downwardly when unsupported with the first gripping member 26 being lower than the second gripping member 28 due to gravitational forces acting upon the attaching system 20. In preferred embodiments, the pivoting range of motion of the attaching system 20 is limited due to the geometry of the attaching system 20, the carriage 10, a stopper (not shown) or any other suitable means.

Referring to FIG. 1, the fulcrum 36 may be configured to support the attaching system 20 about the second gripping member 28 when the carriage 10 is moved downwardly towards the distal end of the elongated member 40. In this manner, the vertical displacement of the attaching system 20 may be limited as the carriage 10 continues to move downwardly towards and/or into the recess 38. Due to the geometry of the carriage 10, of the attaching member 20 and of the fulcrum 36, the attaching member 20 may begin to pivot about the pivot point 15 to reach a substantially horizontal position when or after the attaching member 20 is in contact with the fulcrum 36 with the first gripping member 26 being at a similar height to the second gripping member 28.

In other embodiments, the fulcrum 36 may be replaced by a resilient member or any pivoting system allowing the attaching member 20 to be pivoted when engaging with the stake 5 as to be substantially parallel with the ground (or substantially perpendicular with the stake 5).

Figure 6:
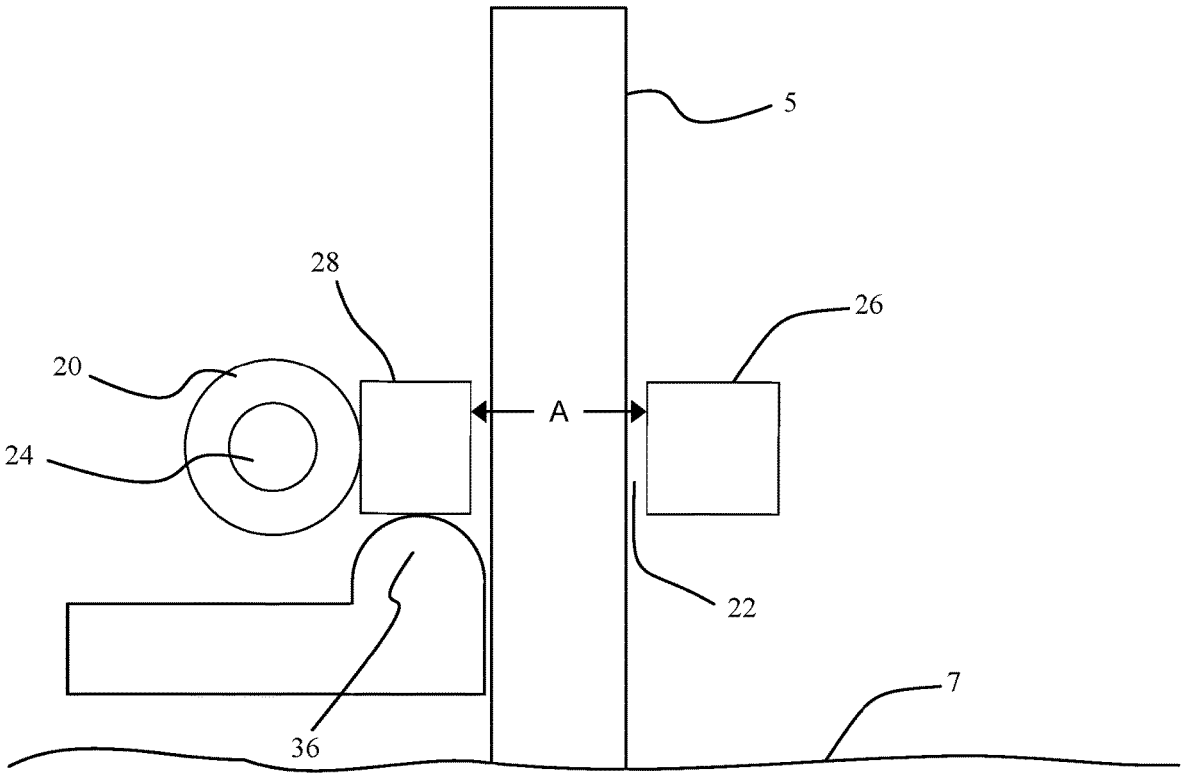
FIG. 6 is a right side elevation view of an exemplary attaching system used in the stake removal tool of FIG. 1 shown when receiving a stake.

Referring now to FIG. 6, it may be appreciated that the lateral distance A between the two engagement members 26 and 28 may reach a maximum distance when the attaching member 20 is in a substantially horizontal position thereby facilitating the reception of the stake 5 within the opening 22.

Figure 7:
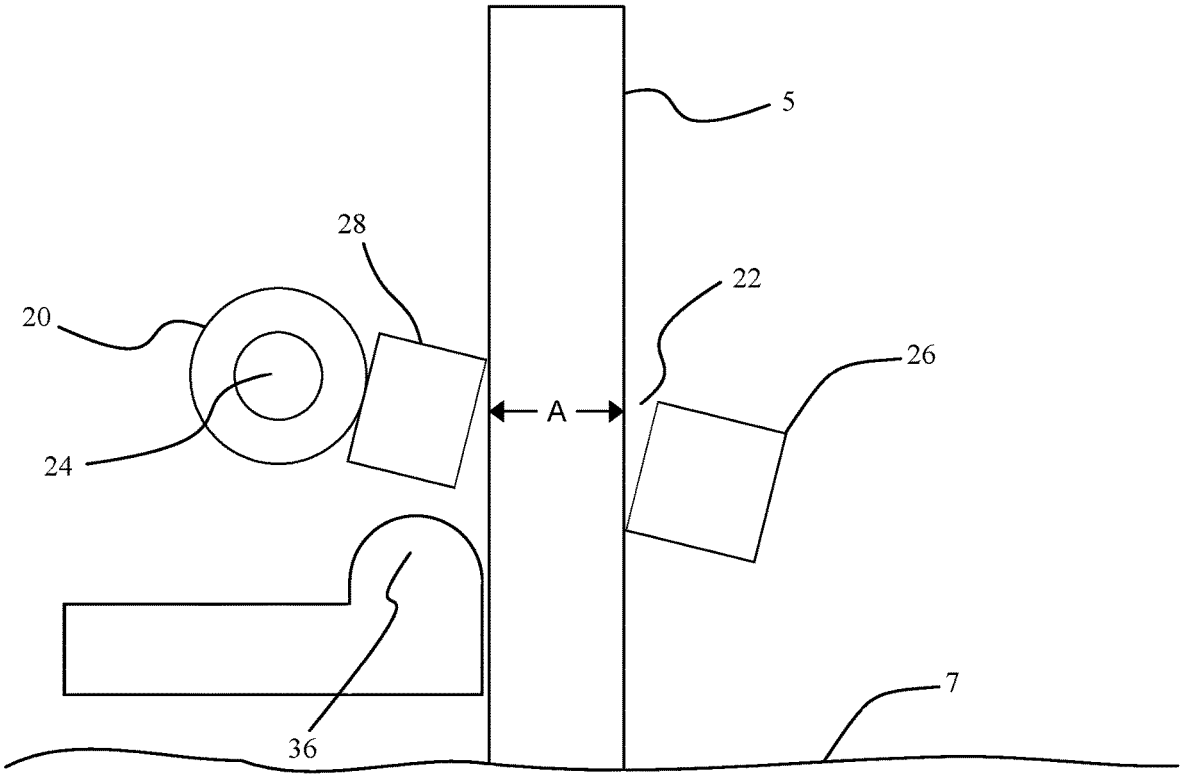
FIG. 7 is a right side elevation view of the attaching system of FIG. 6 shown when engaging a stake.

Referring now to FIG. 7, the lateral distance A between the two engagement members 26 and 28 may decreases as the link 24 is driven upwardly thereby forcing the attaching member 20 to pivot due to gravitational forces. In such conditions, the first gripping member 26 is typically lower relative to the second gripping member 28. The first and second engagement members 26, 28 may be configured to conjointly engage the stake 5 positioned within the opening 22 as the lateral distance A is decreased.

In a preferred embodiment, the stake removal tool 100 may be configured to force the stake 5 upwardly and to dislodge it from the ground 7 as the attaching member 20 pivots when it is raised. Once the stake 5 has been dislodged, the carriage 10 may continue to be driven upwardly by the lift system 50. As carriage 10 is driven upward, the gravitational forces still force the attaching member 20 into its pivoted state, thus allowing the engagement members 26, 28 to maintain their grip on the stake 5. To that end, the stake 5 may be removed from the ground 7 as the carriage 10 continues to be driven upwardly.

Understandably, any other methods to grip or attach the stake by moving the carriage 10 up and down may be used within the scope of the present invention. As such, in some embodiments, a roller may be pushed against the stake to maintain pressure against a gripping member.

The lifting system 50 typically comprises a drive system (not shown) configured to drive the lift system 50. The drive system may comprise any suitable system to operate and control the lift system such as, for example, an engine, a motor or more preferably a power tool such as a drill configured to engage and rotate the endless screw 52. The stake removal tool 100 may further comprise a drive bracket 54 adapted to align the axle of the drive system with the rotational axis of the endless screw to increase mechanical efficiency and generally to avoid side forces on the pivoting shaft, which may create breakages.

The drive bracket 54 may be adapted to be securely attached to the drive motor and to the elongated member 40. In one embodiment, the drive motor may be dismantled, the bracket 55 may be inserted within the two or more dismantled parts and be secured within the drive motor, offering a rigid connection to the drive motor.

In certain embodiments, the endless screw 52 may be axially connected to a socket 56, such as a standard socket for drilling. The drive system may be engaged with the socket 56 to turn the endless screw 52 in any direction. A first direction of rotation drives the carriage 10 down while the opposite direction moves the carriage 10 upwards.

To further ease the operation of the stake removal tool, the stake removal tool 100 may comprise one or more handles 60 to be engaged by the user during the operation of the stake removal tool 100, as shown in FIG. 2.

In use, the tool 100 is placed on the ground, typically against the base 30. The tool 100 is positioned to align the elongated member 40 or the attaching member 20 with the stake 5 in the ground 7. The drive system 50 is activated to move the carriage 10 down, such as rotating the endless screw 52 in a first direction. When the attaching system 20 has made contact with the fulcrum 36 and pivoted sufficiently to engage and dislodge the stake 5 from the ground 7, the drive system 50 is stopped and/or reversed to move the carriage 10 upwards (the endless screw 52 turns in a second direction, opposite to the first direction). By moving up, gravitational forces pivot the attaching system 20 in an opposite direction once again engaging the stake 5. As the carriage 10 moves up, the stake 5 is solidly gripped between the first and second gripping members 26 and 28.

Referring now to FIGS. 8 to 12, another embodiment of a stake removal tool 200 is illustrated. The stake removal tool 200 similarly comprises a carriage 210, an attaching system 220, a base 230, an elongated member 240 and a lifting system 250.

Figure 11:
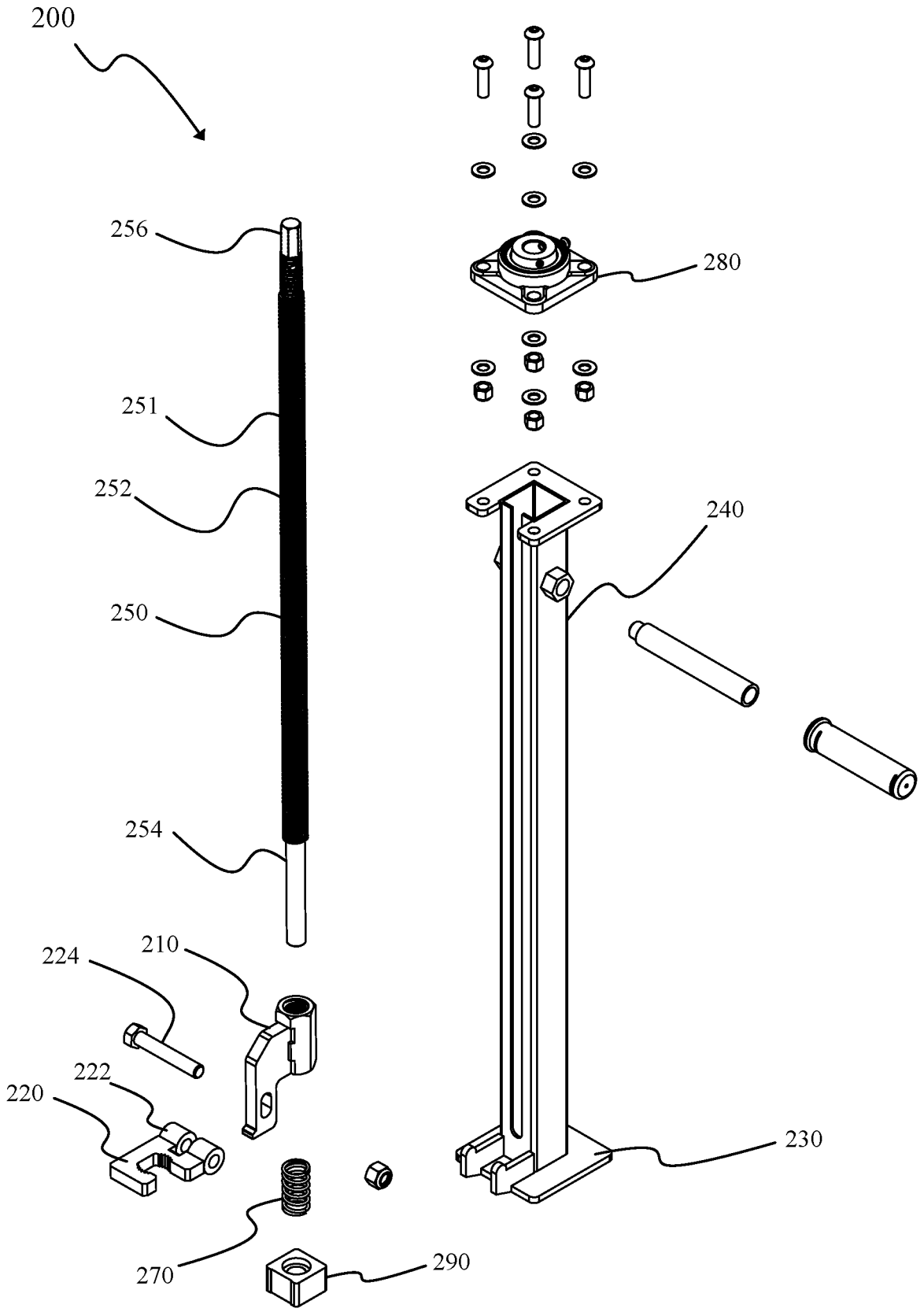
FIG. 11 is an exploded isometric view of the stake removal tool of FIG. 8.
Figure 12:
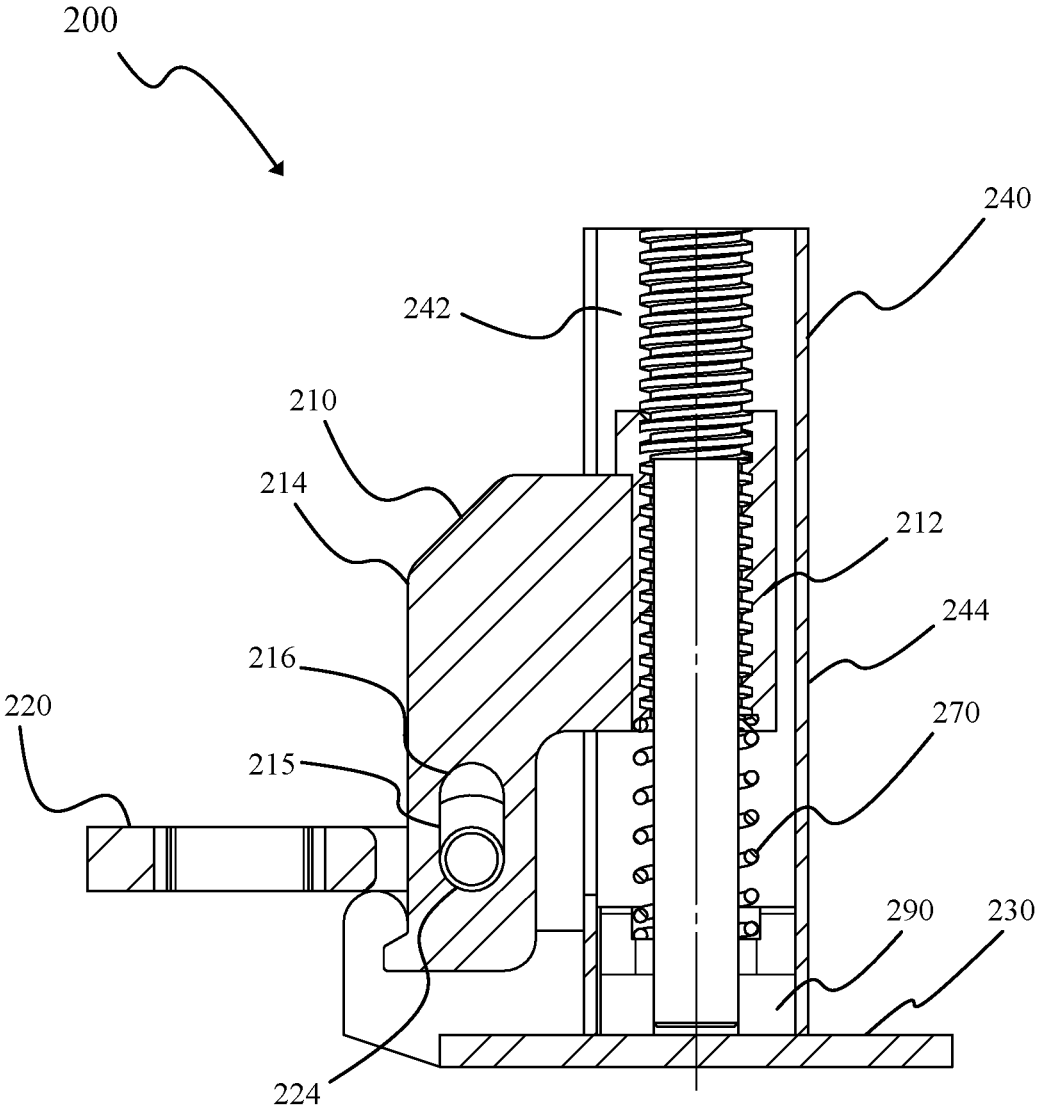
FIG. 12 is a right side cross-sectional view of a distal end of the stake removal tool of FIG. 8.

Referring to FIGS. 11 and 12, the stake removal tool 200 may further comprise a resilient member 270 positioned at a distal end 244 of the elongated member 240. The resilient member 270 may be positioned within an inner cavity 242 of the elongated member 240. The resilient member 270 may comprise a spring, a rubber shock absorber, or any other suitable component for storing mechanical energy. The resilient member 270 may be configured to dampen the displacement or limit the force of impact of the carriage 210 as it is displaced towards its lowest position. In certain embodiments, the resilient member 270 may further limit a displacement of the carriage 210 along the elongated member 240. In the illustrated embodiment, the resilient member 270 is embodied as a spring surrounding the lifting system 250 which allows the carriage 210 to move upwardly and downwardly.

Figure 8:
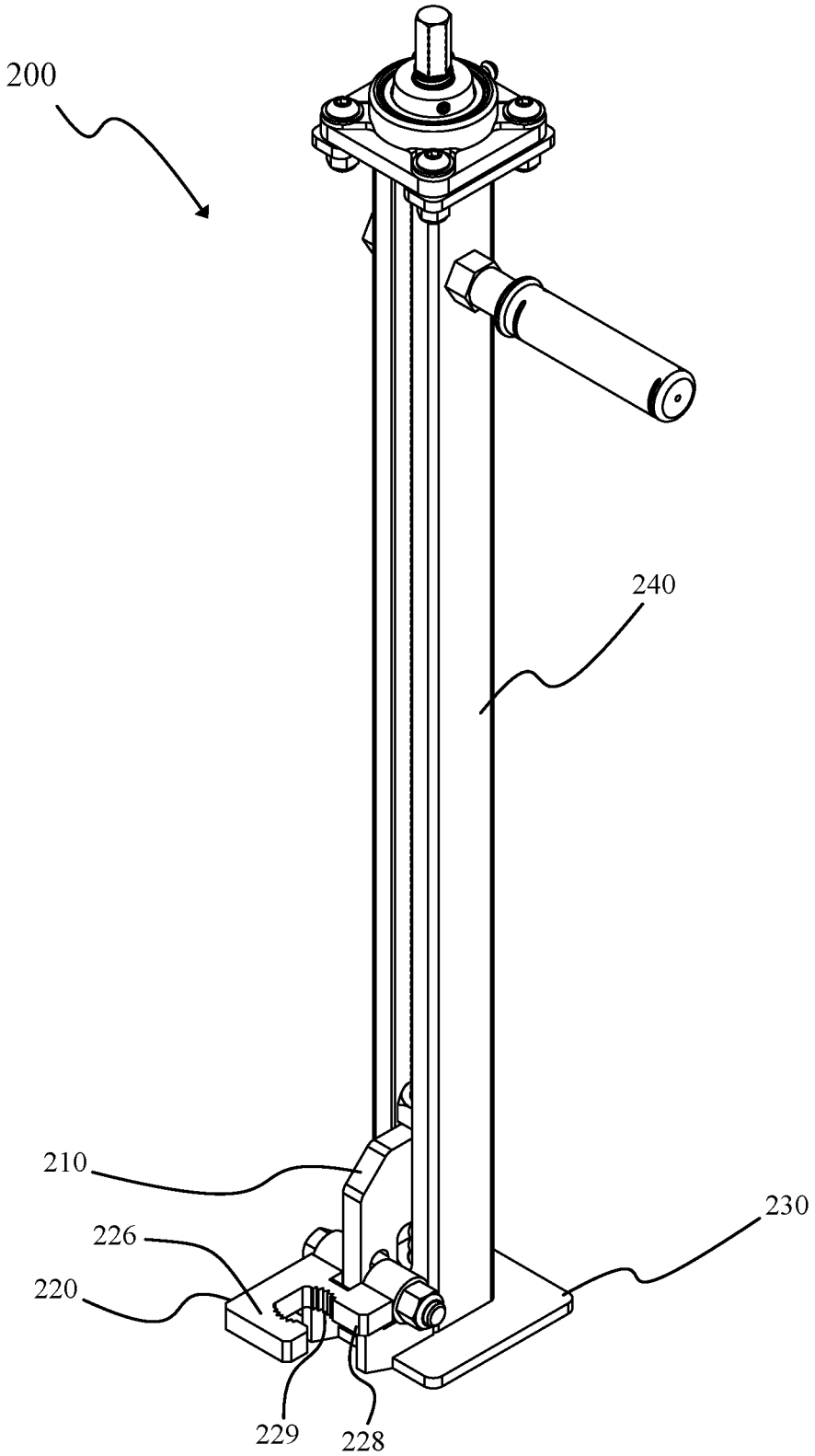
FIG. 8 is an isometric view of another embodiment of a stake removal tool in accordance with the principles of the present invention.
Figure 9:
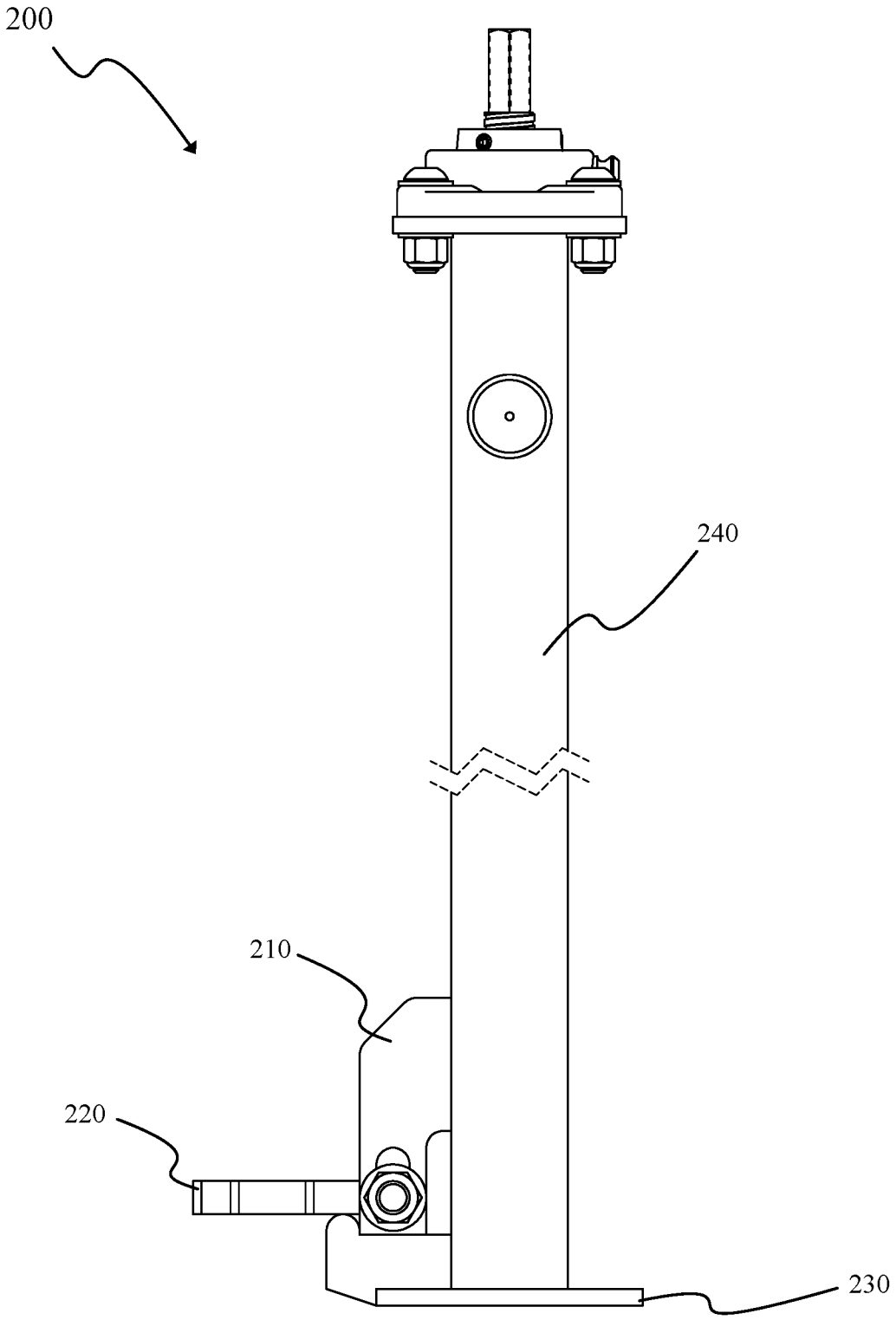
FIG. 9 is a right side elevation view of the stake removal tool of FIG. 8.

Referring now to FIG. 8, the attaching system 220 is pivotally attached too the carriage 210 and is adapted to generally surround the outer surface of a stake to be pulled. When the carriage 210 moves up, the attaching system 220 grips the outer surface of a stake (as shown at FIG. 7). In some embodiments, the attaching system 220 may comprise first and second gripping members 226, 228. In such embodiments, the first and second gripping members 226, 228 generally form a U shape allowing the outer surface of the stake to be inserted within the opening of the U shape gripping members 226, 228.

The attachment system 220 generally comprises a supporting member 224 pivotally attached to the carriage 210. In the illustrated embodiment, the supporting member 224 is kingpin insertable in the pivot point 215 of the carriage. As such, the attachment system 220 may comprise one or more annular members 222 (shown in FIG. 11) adapted to receive the supporting member 224, such as a kingpin.

In certain embodiments, the first and second gripping members 226, 228 may comprise serrations 229 configured to increase the points of contact between the first and second gripping members 226, 228 and the stake 5 while additionally increasing the applied pressure at each contact point. Understandably, the serrations 229 may allow the first and second gripping members 226, 228 to securely grip the stake 5 while additionally preventing a rotation of said stake 5 about its longitudinal axis.

In such embodiment, the carriage 210 comprises a threaded aperture 212 adapted to receive the threaded portion 252 of the lifting system 250. As the threaded portion 252 rotates, the carriage 210 moves upwardly or downwardly following the direction of rotation of the threaded portion 252. In the illustrated embodiment, the threaded aperture 212 is solidly fixed to the body 214 of the carriage 210. In such embodiment, the body 214 of the carriage 210 extends downwardly from the threaded aperture 212 to position the attachment system 220 at the base of the stake 5 to be pulled or removed.

In certain embodiments and referring again to FIGS. 11 and 12, the carriage comprises a pivot point 215 configured to pivotally retain the attaching system 220. In some embodiments, the pivot point 215 may comprise a vertically elongated opening 216. The elongated opening 216 is configured to receive a supporting member 224 of the attaching system 220 while allowing a vertical displacement of said supporting member 224 relative to the carriage 210. By allowing a relative displacement between the supporting member 224 and the carriage 210, the attaching system 220 may remain substantially horizontal while the carriage 210 is in a broader range of positions along the elongated member 240.

Figure 10:
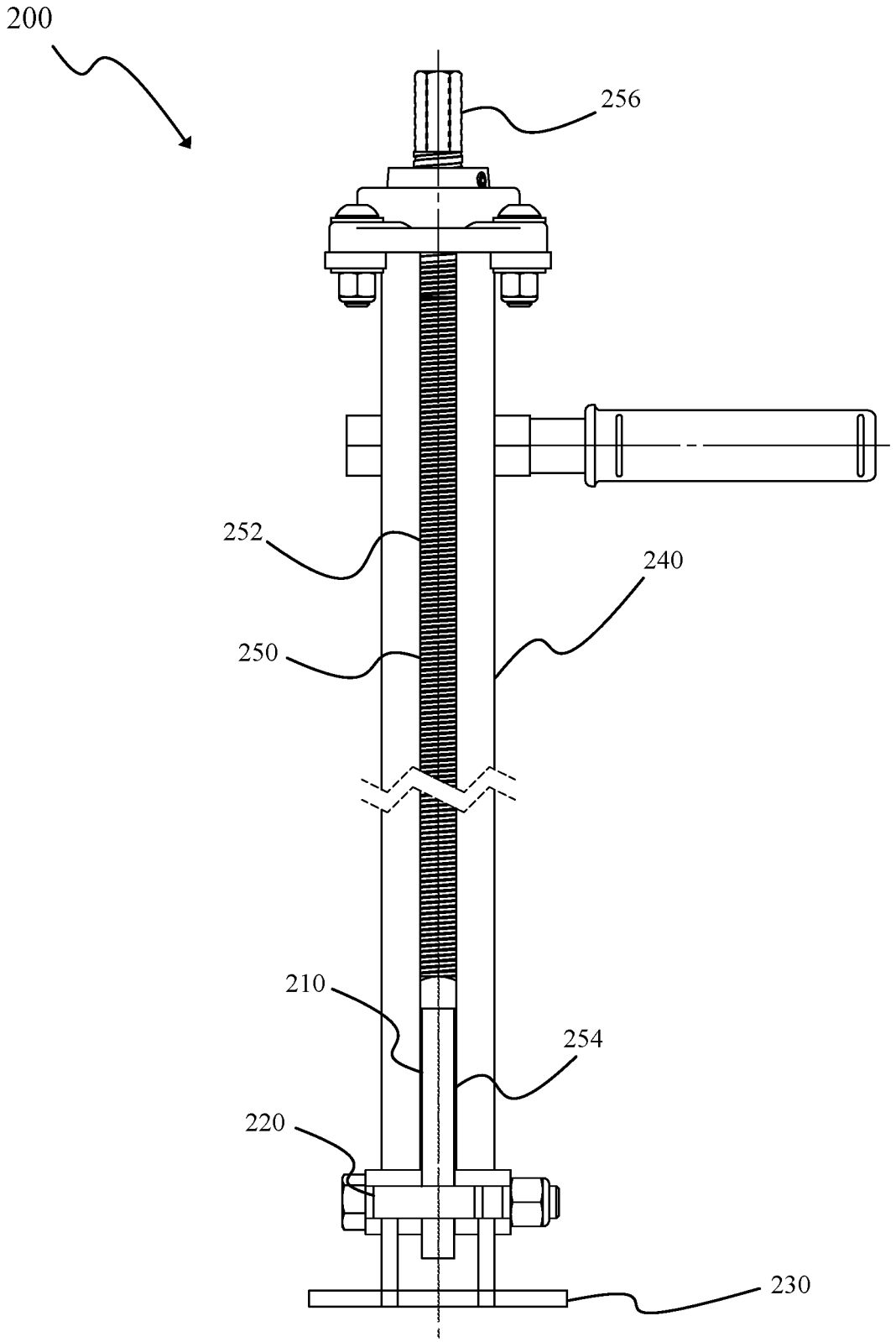
FIG. 10 is front elevation view of the stake removal tool of FIG. 8.

Referring now to FIGS. 10 and 11, the stake removal tool 200 may further comprise a lifting system 250 extending along the elongated member 240 and adapted to displace the carriage 210 upwardly and downwardly. In the illustrated embodiment, the lifting system 250 is embodied as an elongated threaded rod 251. The elongated threaded rod may comprise a threaded portion 252, an axle portion 254 configured to rotate within a support 290, such as a bearing (shown in FIG. 12), and a drive connector 256 configured to engage the drive system. In a preferred embodiment, the lifting system 250 is unitary. In the illustrated embodiment, the threaded portion 252 is between the drive connector 256 and the axle portion 254. The threaded portion 252 is long enough to allow sufficient vertical movement of the carriage 210 to remove the stake from a surface, such as the ground. In the illustrated embodiment, the axle portion 254 is adapted to receive the resilient member 270 and thus has a smooth external surface, such as a non threaded surface. The support 290 may be unitary with the base 240 of the removal tool 200.

The stake removal tool 200 may further comprise a rotating member 280 adapted to receive and facilitate the rotation of the lifting system 250. The rotating member 280 may be a bearing receiving a portion of the elongate rod. In the illustrated embodiment, the drive connector 256 extends above the rotating member 280 to allow a drive system to engage with the lifting system 250. Understandably, any type of bearing, such as standard bearings may be used to embody the rotating member 280.

Referring now to FIG. 11, the stake removal tool 200 may comprise a handle 260. The handle 260 typically extends from the side of the elongated member 240. In some embodiments, the handle 260 may comprise a friction cover 262. The friction cover 262 generally improves gripping of the tool by a hand of a user.

Referring back to FIGS. 11 and 12, the lifting system 250 may allow disengaging the carriage 210 when moved at the axle portion 254. In the illustrated embodiment, the axle portion 254 is threadless. As such, the carriage 210 is disengaged when moved over the axle portion 254. As such, when disengaged, the carriage 210 is prevented from pushing downwardly on the base 230, therefore avoiding long-term wear of the stake removal tool 200. When the carriage 210 reaches the lower end of threaded part 252, it continues to move downwards over the axle portion 254 until disengaged from the threaded portion 252. When completely disengaged, the carriage 210 stops moving downwards. The support 290 may be unitary with the base 240 of the removal tool 200.

In the illustrated embodiment, when the carriage 210 is disengaged from the lifting system 250, the resilient member 270 pushes the carriage 210 upwardly over the threadless axle portion 254. When the lifting system 250 is rotated to move the carriage 210 upwardly, the carriage 210 engages with the threaded portion 252 and can be moved upwardly towards the upper portion of the lifting system 250.

While illustrative and presently preferred embodiments of the invention have been described in detail hereinabove, it is to be understood that the inventive concepts may be otherwise variously embodied and employed and that the appended claims are intended to be construed to include such variations except insofar as limited by the prior art.

The invention claimed is:

1. A stake removal tool configured for removing in-ground stakes, the stake removal tool comprising:
- an elongated member defining a first end portion and a second end portion;
- a carriage comprising a stake engagement assembly configured to engage and grasp the stake;
- a lift system configured to drive the carriage along a longitudinal direction of the elongated member;
- a carriage disengagement member comprising a non-threaded axle portion for disengaging the driven carriage from the lift system before the carriage reaches the first end portion of the elongated member; and
- a carriage engagement member comprising:
  - a resilient member for moving the disengaged carriage toward the lift system;
  - a threaded portion for threadingly engaging the carriage.

2. The stake removal tool of claim 1, the stake removal tool further comprising a fulcrum, the stake engagement assembly further comprising a pivoting member abutting the fulcrum and configured to pivot about the fulcrum to engage the stake.

3. The stake removal tool of claim 2, the pivoting member further comprising an opening that defines a passage between the first and second engagement members.

4. The stake removal tool of claim 2, wherein the passage is larger than a width of the stake when the opening extends in a plane substantially normal to the longitudinal axis of the stake.

5. The stake removal tool of claim 4, wherein the passage is smaller than the width of the stake when the pivoting member and the opening are pivoted relative to the longitudinal axis of the stake.

6. The stake removal tool of claim 5, wherein a rotation of the pivoting member is limited by the width of the stake when said stake is in the opening and the pivoting member is pivoted.

7. The stake removal tool of claim 2, the pivoting member being configured to remove the stake from the ground when the engagement members grasp the stake and the carriage is driven upwardly.

8. The stake removal tool of claim 2, wherein the pivoting member loosely pivots about a pivot point of the carriage.

9. The stake removal tool of claim 2, wherein the pivoting member pivots about an elongated aperture of the carriage.

10. The stake removal tool of claim 2, the stake engagement assembly comprising defining first and second engagement members, the first and second engagement members being configured to engage the stake and grasp the stake when the pivoting member is pivoted.

11. The stake removal tool of claim 10, wherein at least one of the first and second engagement members comprises serrations.

12. The stake removal tool of claim 2 further comprising an abutment member being attached to a base of the tool, when contacting the abutment member, the fulcrum allowing the stake to be inserted.

13. The stake removal tool of claim 1, wherein the lifting system comprises an elongated rod rotatably attached to the stake removal tool, the elongated rod comprising: the threaded portion for threadingly engaging the carriage; the non-threaded axle portion for receiving the resilient member and for disengaging the carriage.

14. The stake removal tool of claim 1, the resilient member being a spring pushing the disengaged carriage towards the carriage engagement member.

15. The stake removal tool of claim 1, the stake removal tool being a handheld tool.

16. A method for removing a stake from a surface, the method comprising:

driving a carriage downward toward the stake along an elongated member;

disengaging the carriage from the elongated member upon reaching a non-threaded end portion of the elongated member;

inserting the stake into an opening of an attachment member of the carriage;

moving the disengaged carriage to be engaged to a threaded portion of the elongated member; and driving the engaged carriage upward to grasp the stake with the attachment member.

17. The method of claim 16 further comprising pivoting the attachment member to a position being substantially normal to a longitudinal axis of the stake prior to inserting the stake into the opening.

18. The method of claim 16, the driving of the carriage further comprising using a drive system to rotate the elongated member to drive the carriage.

19. The method of claim 16, the disengagement of the carriage further comprising driving the carriage from the threaded portion to the threadless portion of the elongated member.

20. The method of claim 16, the engagement of the carriage further comprising pushing the carriage from the threadless portion of the elongated member to a threaded portion of the elongated member.

21. The method of claim 16 further comprising pivoting the attachment member to insert the stake in the opening and suspending the pivoted attachment member to grasp the stake with the attachment member.

* * * * *